US006932212B2

(12) United States Patent
Ovadia

(10) Patent No.: US 6,932,212 B2
(45) Date of Patent: Aug. 23, 2005

(54) UNITARY MOLDED CLIP FOR JEWELRY

(76) Inventor: Joseph Ovadia, 109 Long Hill Rd., Little Falls, NJ (US) 07424

( * ) Notice: Subject to any disclaimer, the term of this patent is extended or adjusted under 35 U.S.C. 154(b) by 644 days.

(21) Appl. No.: 09/974,762

(22) Filed: Oct. 9, 2001

(65) Prior Publication Data

US 2004/0104132 A1 Jun. 3, 2004

(51) Int. Cl.[7] ..... B65D 6/04; A45C 11/16; A47F 7/00

(52) U.S. Cl. ..... 206/6.1; 206/482; 206/566; 211/85.2

(58) Field of Search ..... 206/6.1, 477, 481–483, 206/493, 560, 562, 565–566; 211/85.2

(56) References Cited

U.S. PATENT DOCUMENTS 5,535,878 A * 7/1996 Reed ..... 206/6.1
5,547,072 A * 8/1996 Kaiser ..... 206/765
5,775,484 A * 7/1998 Ovadia ..... 206/6.1
6,012,570 A * 1/2000 Ovadia et al. ..... 206/6.1
6,029,829 A * 2/2000 Ovadia ..... 211/85.2

* cited by examiner

*Primary Examiner*—Bryon P. Gehman
(74) *Attorney, Agent, or Firm*—Richard M. Goldberg

(57) ABSTRACT

The present invention provides for a unitary molded clip for displaying and storing jewelry. The clip is comprised of a base and first and second downwardly extending sidewalls, where the first and second downwardly extending sidewalls form the boundaries of a recess having a concave surface extending downwardly away from the surface of the base. A tab is provided which extends from the first downwardly extending side wall, projecting across the concave surface of the recess. Also provided is a first winged projection that extends downwardly from the base into the recess toward the tab. When an item of jewelry is inserted between the first winged projection and the tab, the jewelry is secured to the unitary molded clip.

19 Claims, 10 Drawing Sheets

UNITARY MOLDED CLIP FOR JEWELRY

FIELD OF THE INVENTION

The present invention relates to a unitary molded clip for the display and storage of items for sale. More specifically, the present invention relates to a unitary molded clip for the display and storage of jewelry items.

BACKGROUND OF THE INVENTION

Jewelry articles, particularly rings, can be stored and displayed in a variety of trays, holders or racks. The most common type of jewelry display for rings, described generally in U.S. Pat. No. 4,282,975, comprises a pad, generally of a plush felt or velvet material, which is placed in a tray, preferably of square or rectangular shape. The felt pad which rests within the tray is provided with a plurality of downwardly extending recesses into which a ring is inserted and which are generally configured such that the circular shank or lower portion of a ring is retained in the felt. The tray portion of this type of display is often configured to permit a plurality of trays to be nested upon each in stacked fashion.

However, rings and other articles of jewelry are often provided with indicia labels or tags that contain important information such as composition, i.e. gold, silver, platinum, etc., weight, price and/or bar codes. Since indicia labels often detract from the beauty of the jewelry being displayed, some jewelers in the trade neglect to attach indicia tags to the jewelry, resorting instead to looking up price, composition and weight information, etc., in an index or price book. This, however, takes time and customers may become impatient while waiting to receive all the information. Jewelers, thus prefer to attach indicia tags directly to the jewelry so as to have immediate access to all information pertaining to that article. It is, however, preferred by those in the jewelry trade to keep such indicia labels out of sight of potential customers since it is hoped that a customer will first be impressed by the ring which they may see in a store window or display case and then be enticed to enter the store to inquire further before seeing the price of the ring.

Prior art display trays, however, do not permit the rings to be stored and displayed while keeping the indicia tag out of sight. The upper surface of the prior art display tray are often provided with outwardly extending tabs permit only a limited portion of the indicia tag to be inserted underneath the tab. As such, the indicia tab is often left to hang free on the felt or other clip surfaces.

The prior art display trays have also been found to inadequately secure and retain the jewelry items within the display case, particularly when the trays are moved or transported. Often times since the rings are constantly removed and reinserted from the tabs in the felt upper surface, the salesperson neglects to fully insert the ring into the tab, thus leaving the ring in a virtually unsecured condition.

In addition to these drawbacks, the prior art display trays are difficult to clean and manipulate without getting unsightly finger prints on the jewelry items themselves. A need exists not only to create a jewelry display clip which is dust resistant and cleanable in itself, but which also provides a means to manipulate desired jewelry pieces easily and individually without touching the jewelry piece itself.

Yet another concern in jewelry display and storage is the durability of the displays. Prior art clips of previous designs either produce high durability at the expensive of attractive display quality or they are of a good aesthetic quality but lack durability. Thus, there is also a need in the jewelry display and storage industry to provide a jewelry display clip which is not only of durable construction but is also of good aesthetic quality.

Accordingly, there is a need for a jewelry display and storage device employed to display and store articles of jewelry thereon, and which avoids the disadvantages discussed above.

SUMMARY OF THE INVENTION

It is an object of the present invention to provide a means for securely displaying and storing a piece of jewelry.

To this end the present invention provides for a unitary molded clip for displaying and storing jewelry. The clip is comprised of a base platform having first and second downwardly extending sidewalls, where the first and second downwardly extending sidewalls form the boundaries of a recess having a concave surface extending downwardly away from the surface of the base. A tab is provided which extends from the first downwardly extending side wall projecting across the concave surface of the recess. Also provided is a first winged projection that extends downwardly from the base into the recess towards the tab. When an item of jewelry is inserted between the first winged projection and the tab, the jewelry is secured to the unitary molded clip.

The present invention also provides for a second winged projection positioned opposite the first winged projection which extends downwardly from the base into the recess toward the tab. The first and second winged projections are recessed relative to the base of the unitary molded clip and spaced apart from the first and second downwardly extending walls and the tab.

In one embodiment of the present invention, the recess is triangular in shape, formed by the first and second downwardly extending walls and the first and second winged projections. The recess is preferably at either a 15 degree or a 25 degree angle downward from the plane of the base. The second downwardly extending wall of the recess forms a guideway in which to manipulate the jewelry into a position between the tab and the first winged projection.

In one embodiment of the present invention, the unitary molded clip is made of plastic and is produced by injection molding. Both the first and the second winged projection are also constructed of a resilient plastic.

DESCRIPTION

In one embodiment of the present invention a unitary molded clip 2 is provided for the display of and storage of jewelry items. Unitary molded clip 2, provides retailers and sales persons added advantages including but not limited to, sturdy and aesthetically pleasing display of jewelry, clean dust resistant construction that allows the jewelry to be manipulated without touching the piece itself, easy storage and travel and configurations, gaps through which unsightly tags can be concealed and versatility is display.

Clip 2 is preferably constructed of a durable dust-repellant plastic such as lexan. The advantages to Lexan include but are not limited to durable construction, resilient properties which lend themselves to the clip features discussed in more detail below, easily moldable into various shapes and designs during construction and the durable construction allow jewelry to be steam cleaned while still in clip 2. However, the use of Lexan is in no way intended to limit the scope of the present invention. Clip 2 can be constructed of any material provided it is capable of supporting the functions of clip 2. For the purposes of illustration, clip 2 referred to throughout the application will be of a plastic construction. As clip 2 is constructed of plastic and because of its unitary construction, a large number of clips 2 can be produced quickly and cheaply by injection molding.

Figure 1:
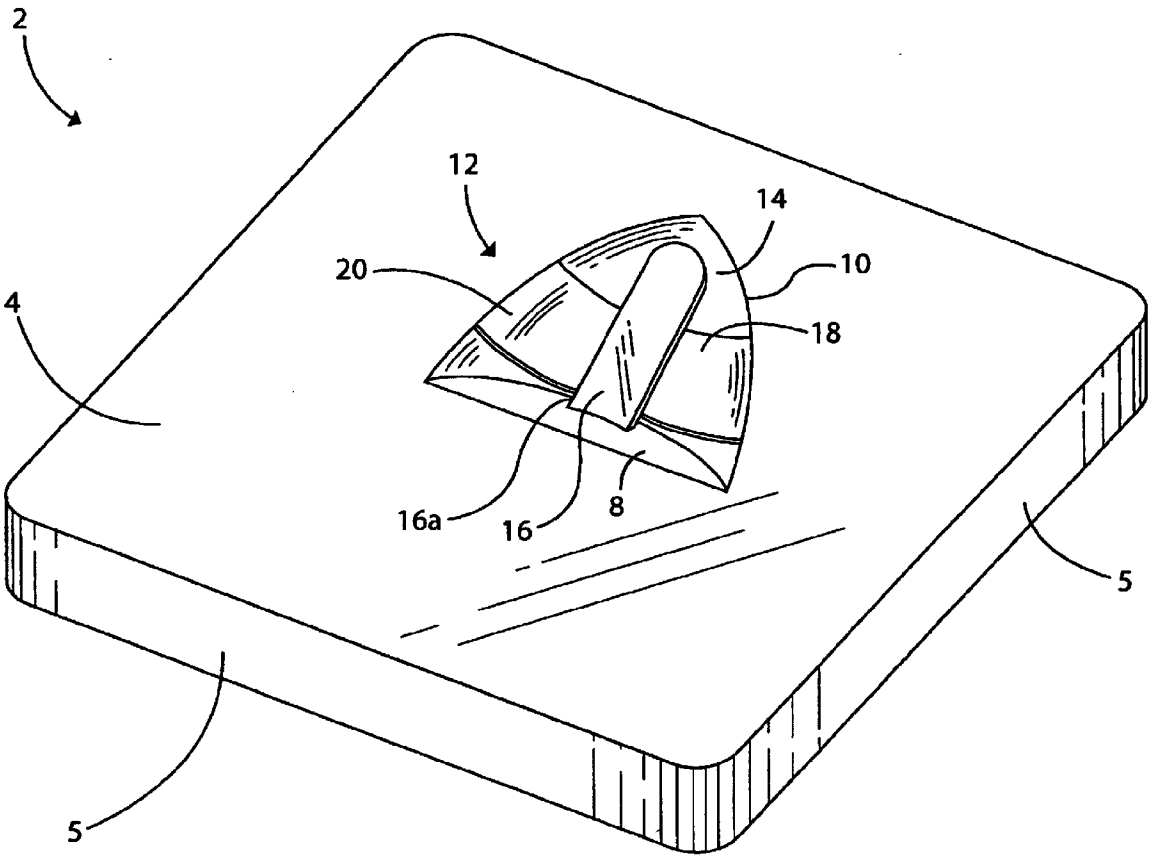
FIG. 1 illustrates a top elevation of a unitary molded clip, in accordance with one embodiment of the present invention.

In another embodiment of the present invention, as illustrated in FIG. 1, clip 2 includes a base 4 and side walls 5. Base 4 is preferably a flat plastic plane and provides the main body of clip 2. Sidewalls 5 provide support for base 4 such that the flat plane of base 4 is elevated off of the surface on which clip 2 is placed. Base 4 and the accompanying sidewalls 5 can be constructed of transparent, translucent or opaque plastic, and can be constructed in any color including clear plastic. Additionally, as per the purchasers desire, base 4 may be smooth surfaced or textured so as to meet the aesthetic requirements of the purchaser. An example of textured for the surface of base 4 may include but is not limited to dimpled surfaces, leather like surface and/or rope bordered.

Figure 1A:
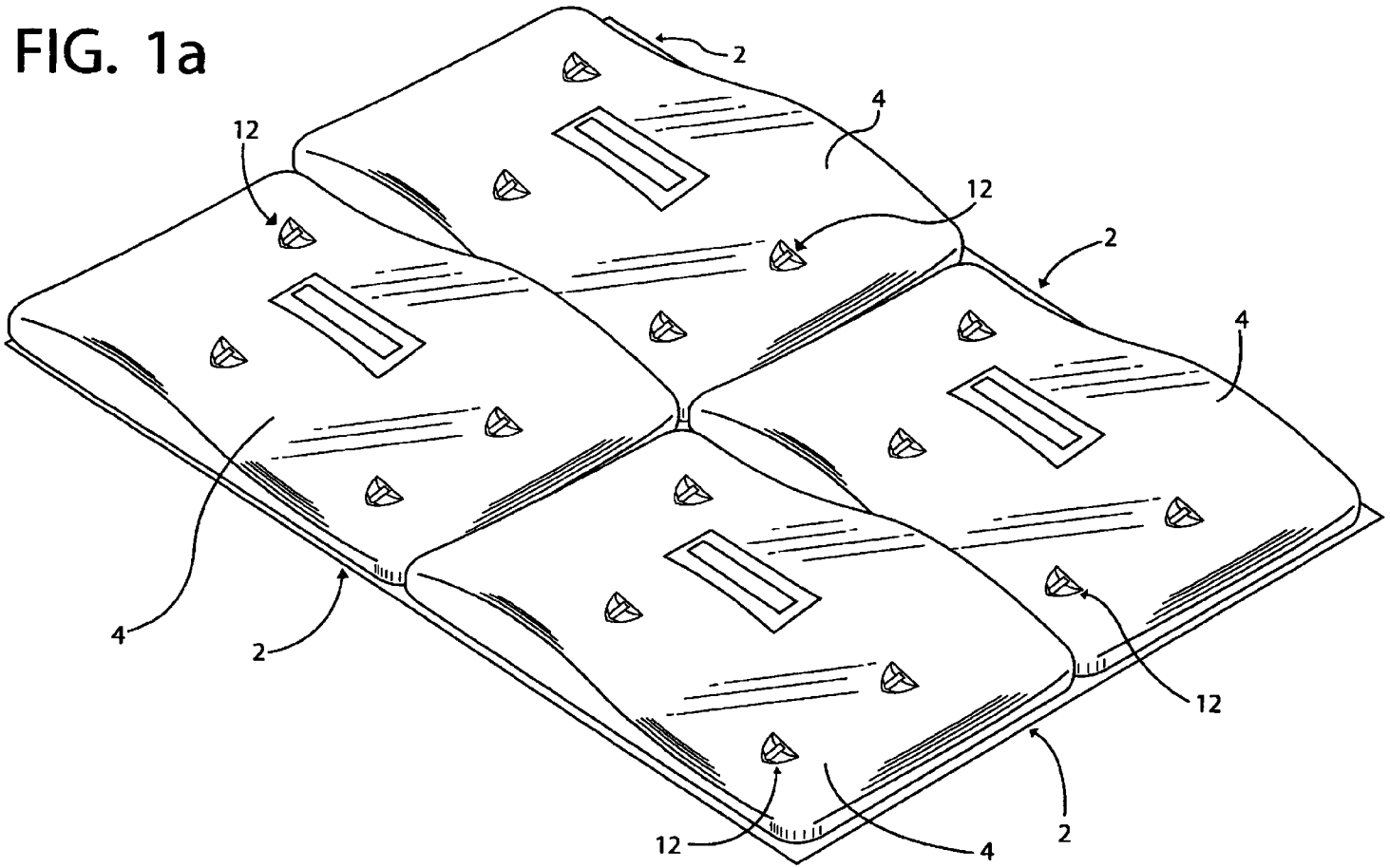
FIG. 1A illustrates a top elevation of a unitary molded clip, in accordance with another embodiment of the present invention.

As illustrated in FIG. 1, base 4 represents a single clip 2 however, this is in no way intended to limit the scope of the present invention. For example, as illustrated in FIG. 1A, base 4 supports of number of individual clips 2. This formations allows for several advantages including but not limited to custom design clips 2 for display and easy storage of multiple jewelry pieces 6 for easy display and storage for travel.

Figure 1B:
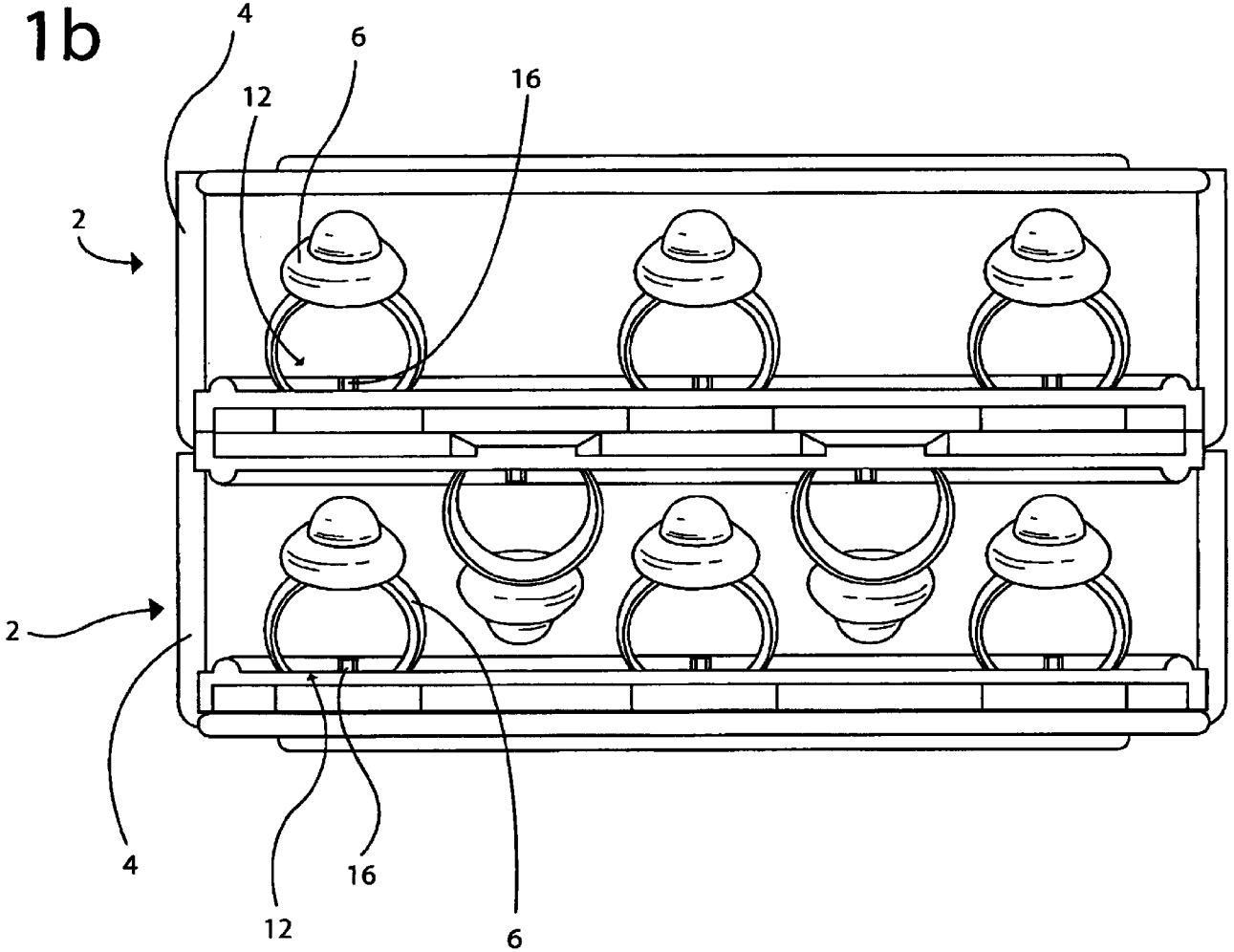
FIG. 1B illustrates a top elevation of a unitary molded clip, in accordance with another embodiment of the present invention.

In another embodiment of the present invention, as illustrated in FIG. 1B multiple clips 2 can be arranged on bases 4 such that when placed together in storage, jewelry pieces 6 interlock between for maximization of storage space. This configuration is ideal for traveling sales persons who wish not only to securely transport a large number of jewelry pieces 6 but also desire the ability to quickly convert jewelry 6 from a stored position to an aesthetic display position.

As the salient features of an individual clip 2 remain constant regardless of the number of clips 2 present on base 4, for the purposes of illustration base 4 will be discussed throughout as a base 4 which maintains a single clip 2.

Base 4 and the accompanying sidewalls 5, can be of any shape or size desired by the purchaser. As illustrated in FIG. 1, base 4 is preferably a standard shape such as a square, so that a purchaser who orders multiple clips 2 will have the added display flexibility to move various jewelry pieces 6 around without having to exchange pieces 6 between different clips 2 having different shapes for base 4. Other shapes for base 4 includes circles as in FIGS. 5A and 5B.

Clip 2 further maintains first and second downwardly extending walls 8 and 10 which form a recess 12 in the surface of base 4. First downwardly extending wall 8 is angled at pitch of between 5–30% from vertical. This pitch provides a steep angled wall 8 against which the shank portion of a jewelry piece 6 can rest against in order to properly display piece 6.

Second downwardly extending wall 10 is angled at a pitch between 5–30% from horizontal. This pitch provides clip 2 with a guideway14 by which jewelry piece 6 can be lowered into position as described later.

As illustrated in FIG. 1, first and second downwardly extending walls 8 and 10, and guideway 14 form recess 12 in the plane of base 4. The shape of recess 12 is preferably triangular or semi-elliptical with first downwardly extending wall 8 forming the bottom of the triangle, or cross section of the semi-ellipse, and second downwardly extending wall 10, and guideway 14 produced therefrom, form the upper two portions of the triangle or the curved portion of the semi-ellipse.

Also, as illustrated in FIG. 1, it should be noted that the angle from vertical at which first downwardly extending wall 8 progresses away from base 4 corresponds to the angle from horizontal that second downwardly extending wall 10 progresses away from base 4. For example, if second downwardly extending wall 10 were to be at angle of 15 degrees from horizontal then first downwardly extending wall would be at 15 degrees from vertical. As such, although downwardly extending walls 8 and 10 do not intersect, the hypothetical extrapolated intersection point of downward extending walls 8 and 10 would meet at a 90 degree angle.

Figure 3:
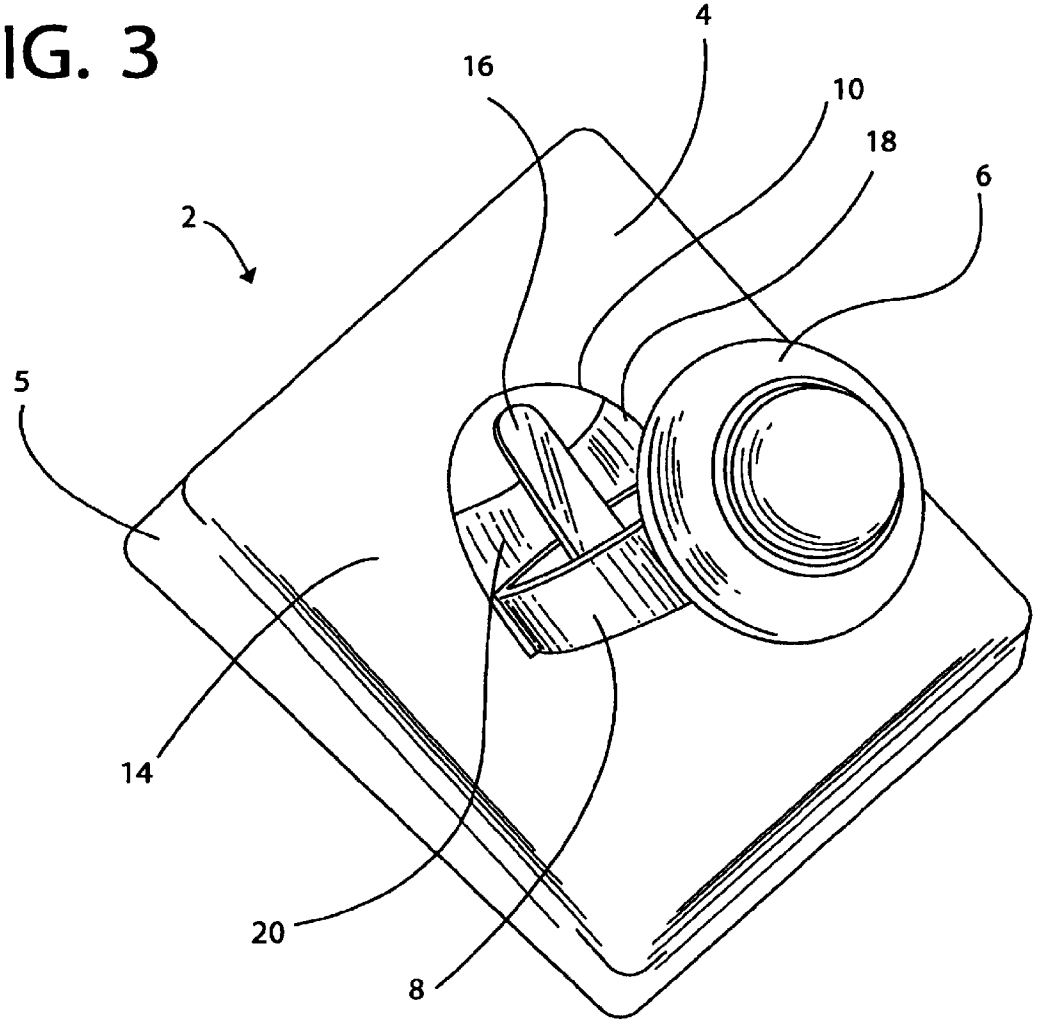
FIG. 3 illustrates a top elevation of a unitary molded clip with an attached jewelry piece, in accordance with another embodiment of the present invention.

In this configuration, and as shown in FIG. 3, when jewelry piece 6 is placed in clip 2, piece 6 will fit squarely and snugly into clip 2. The angle for both first and second downwardly extending walls 8 and 10 is preferably 15 degrees or 25 degrees, however any complementary angles can be used depending on the purchaser's wishes. It should also be noted that although it is preferable that the angles of first and second downwardly extending walls 8 and 10 be equal there is no requirement per se. For example, it is possible that the angles be only substantially similar, or in the case of oddly shaped jewelry entirely different. However, and for the purposes of illustration, the angle from vertical for first downwardly extending wall 8 and the angle from horizontal for second downwardly extending wall 10 are equal.

Clip 2 is further provided with a tab or projection 16, as illustrated in FIG. 1, which extends perpendicular away from first downwardly extending wall 8 out across recess 12. Tab 16 is resiliently constructed such that it maintains near rigidity, but is flexible enough to allow for jewelry piece 6 to bend tab 16 slightly while being placed into clip 2. It should be noted that the relative rigidity of tab 16 can be varied depending upon the purchaser's specification as set based on the type of jewelry 6 to be used in clip 2.

Tab 16 of clip 2 is positioned from first downwardly extending wall 8 such that its lower face 16*a* is above the upper surface of guideway 14 formed by second downwardly extending wall 10. As such, tab 16 extends away from downwardly extending wall 8 at the same angle from horizontal that second downwardly extending wall 10 progresses from base 4, such that tab 16 is substantially parallel to guideway 14 forming an opening by which a user could slide jewelry piece 6 between.

Clip 2 is further provided with plastically deformable first and second wing projections 18 and 20 which are diametrically opposed to one another on either side of recess 12 and extend downwardly away from base 4 into recess 12. First and second wing projections 18 and 20 are separate from first downwardly extending wall 8 and progress downwardly into recess 12 under tab 16. Although first and second wing projections 18 and 20 do not meet, they approach one another leaving a small gap between the two. Additionally, first and second wing projections 18 and 20 each progress into recess 12 along the edges of first and second downwardly extending walls 8 and 10, however there are gaps between wings 18 and 20 on either side between downwardly extending walls 8 and 10.

Figure 2:
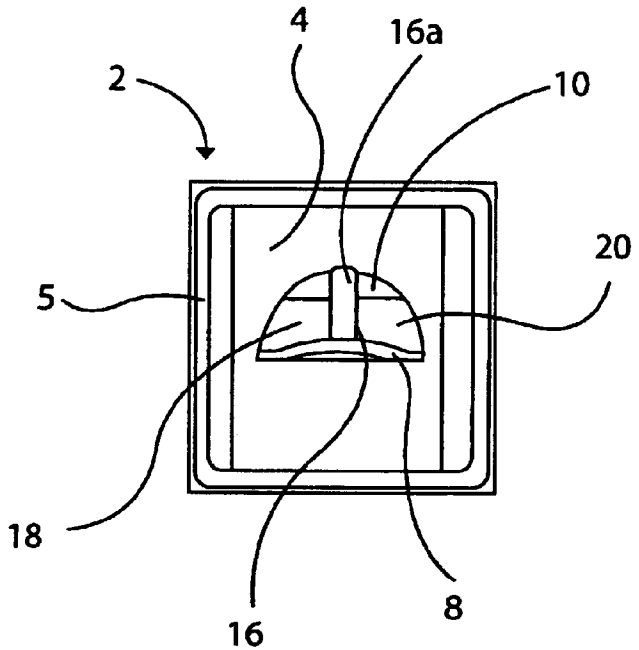
FIG. 2 illustrates a bottom view of a unitary molded clip, in accordance with another embodiment of the present invention.
Figure 2:
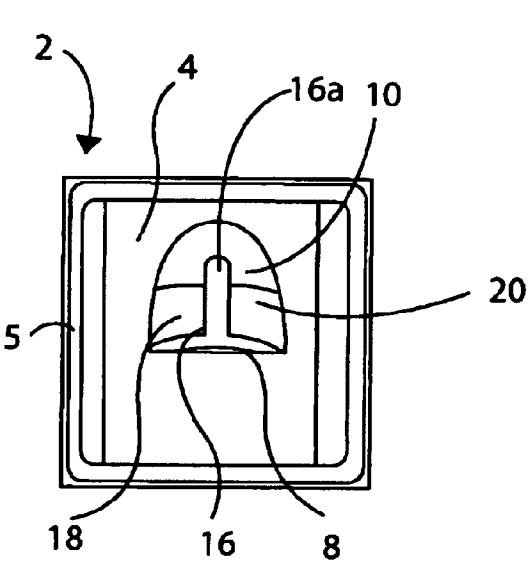

As such, in this configuration, as illustrated in FIG. 2, recess 12 which extends below the surface of base 12 is formed by guideway 14 of the second downwardly extending wall 10, first downwardly extending wall 8 and first and second winged projections 18 an 20. A gap is provided between each of these components so as to allow the deformable wings to be resilient such that when jewelry piece 6 is inserted into clip 2, winged projections 18 and 20 will be able to move independently of first and second downwardly extending walls 8 and 10, and thus be able to apply upward pressure against jewelry piece 6 into tab 16.

It should be noted that the illustrated winged projections 18 and 20 are in no way intended to limit the scope of the present invention. For example, clip 2 may maintain a single winged projection (not pictured) which extends not only to tab 16 but partly across the under side of tab 16, such that a single winged projection would maintain the entire function of wing projections 18 and 20. Alternatively, multiple winged projections such as four or six winged projections (not pictured) could be used by adding additional gaps within the structure of first and second winged projections 18 and 20 creating additional winged projections. In this configuration, the use of additional winged projections may increase the versatility of clip 2 to facilitate the accommodation of varying sizes of jewelry pieces 6. Any similar clip 2 which utilizes any number of resilient winged projections is within the contemplation of the present invention.

Figure 4:
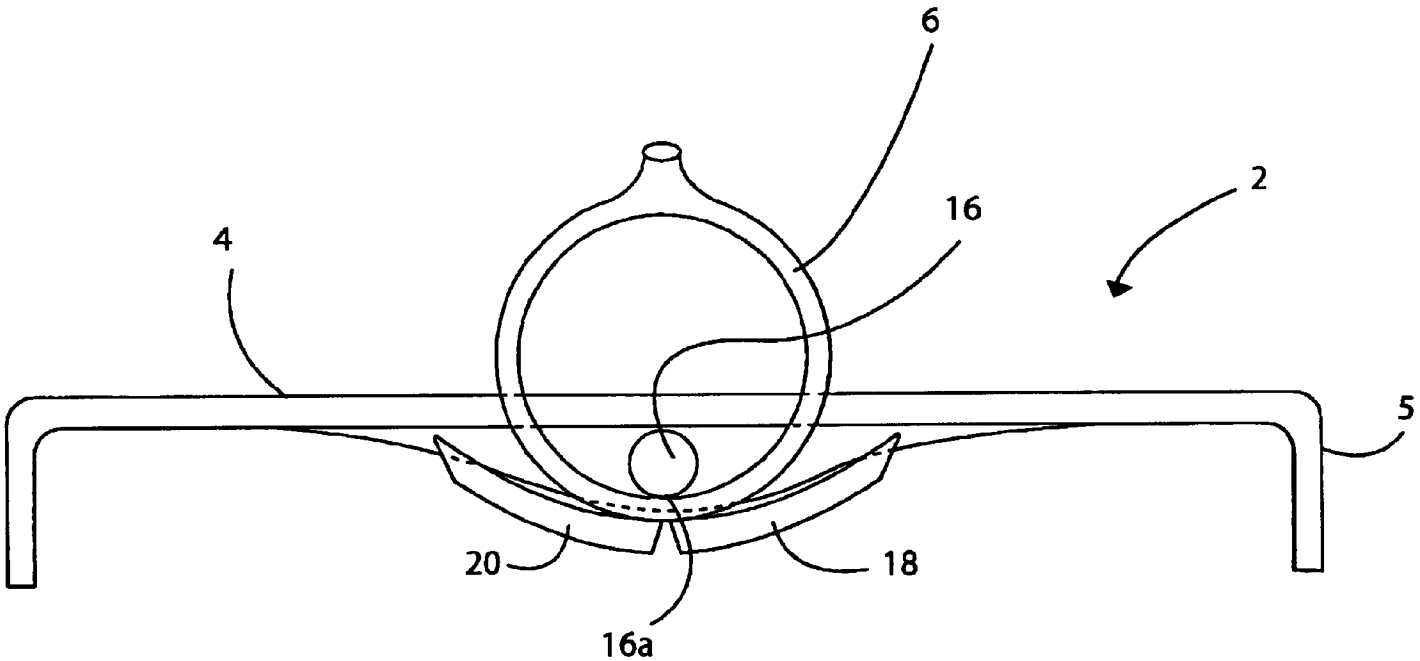
FIG. 4 illustrates a cross-sectional elevation of a unitary molded clip with an attached jewelry piece, in accordance with another embodiment of the present invention.

In use, as illustrated in FIGS. 3 and 4, the operator of clip 2 places jewelry piece 6 down along guideway 14 such that the bottom shank portion of a ring or other jewelry piece 6 to be displayed is clipped between tab 16 and first and second winged projections 18 and 20. The resilient quality of winged projections 18 and 20 and of tab 16 allow just enough movement so that jewelry piece 6 can fit snugly into position. Not only does this allow for secure display of jewelry piece 6, but also the resilient qualities of winged projection 18 and 20 to support any size ring or jewelry piece 6.

In order to properly display and store jewelry piece 6 it is positioned all the way back in clip 2 such that the shank of piece 6 is secured not only against wings 18 and 20 and tab 16, but jewelry piece 6 is also positioned snugly against first downwardly extending wall 8, such that the shank of jewelry piece 6 maintains the same angle as first downwardly extending wall 8.

In this configuration, as illustrated in FIG. 3, jewelry piece 6 is not only held in place but it is also held at near vertical angle such that the featured jewel of piece 6 faces directly towards the customer's eye. The specific angle at which jewelry piece 6 is displayed is based on the angles for first and second downwardly extending walls 8 and 10, discussed above, as chosen by the purchaser of clip 2.

Once jewelry piece 6 is in position, winged projections 18 and 20, due to their resilient quality, hold piece 6 up against tab 16. In this position there are many options to the retailer or sales person of jewelry piece 6. For example, as discussed above, in this position piece 6 can be displayed, moved, viewed by a customer, or placed into a container for storage and transport, all without touching piece 6. This allows complete viewing, movement and storage of jewelry piece 6 without depositing any unwanted fingerprints. In this configuration, the not only is jewelry piece six in a position to properly display it to the customer, but also the tags used to identify the pieces can be placed through the gaps between tabs 16 and winged projections 18 and 20 so that the tags are placed under base 4, increasing the overall aesthetic quality of the display.

Figure 5A:
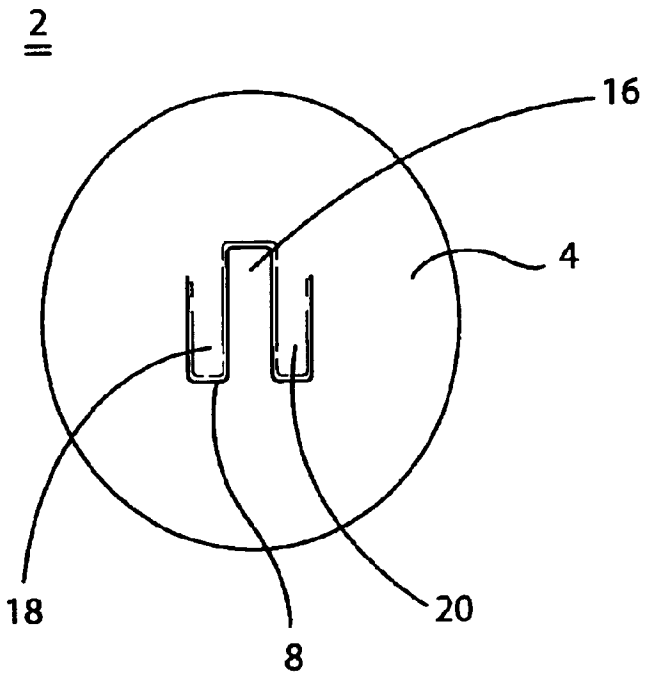
FIG. 5A illustrates a top view of a unitary molded clip, in accordance with another embodiment of the present invention.
Figure 5B:
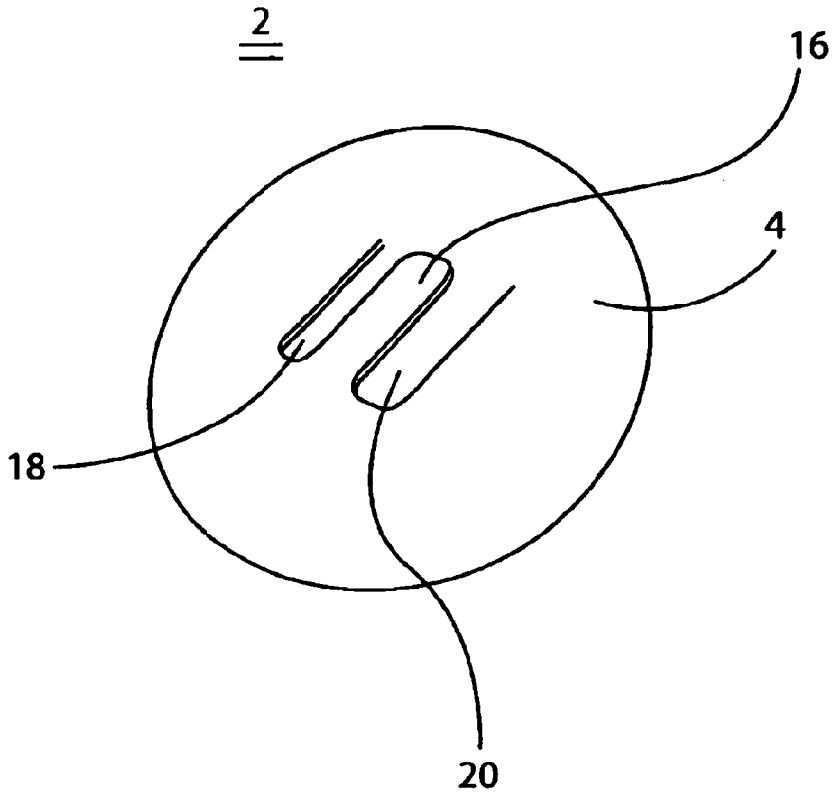
FIG. 5B illustrates an angled top elevation view of a unitary molded clip, in accordance with another embodiment of the present invention.
Figure 6:
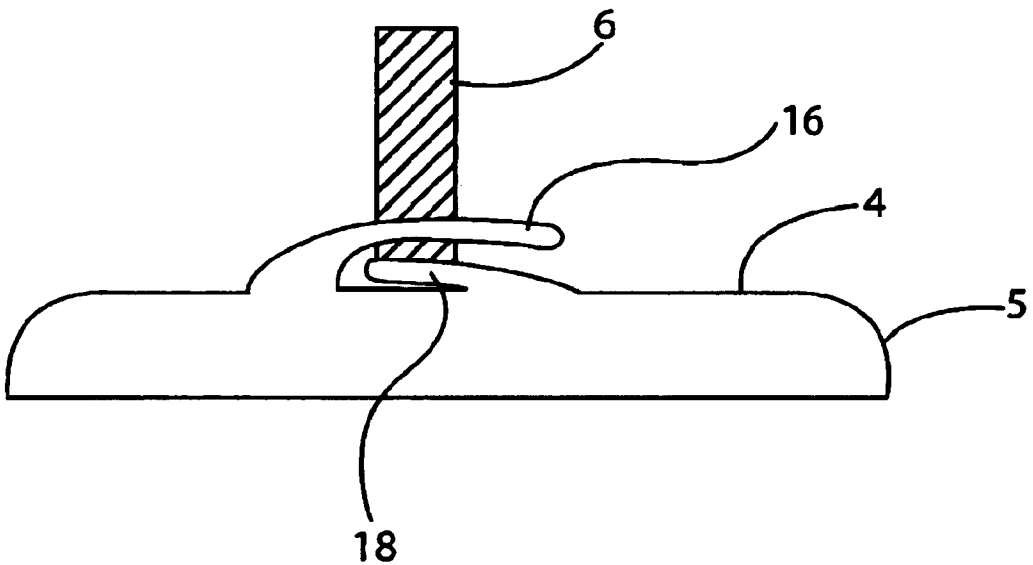
FIG. 6 illustrates a side elevation view of a unitary molded clip, in accordance with another embodiment of the present invention.
Figure 7:
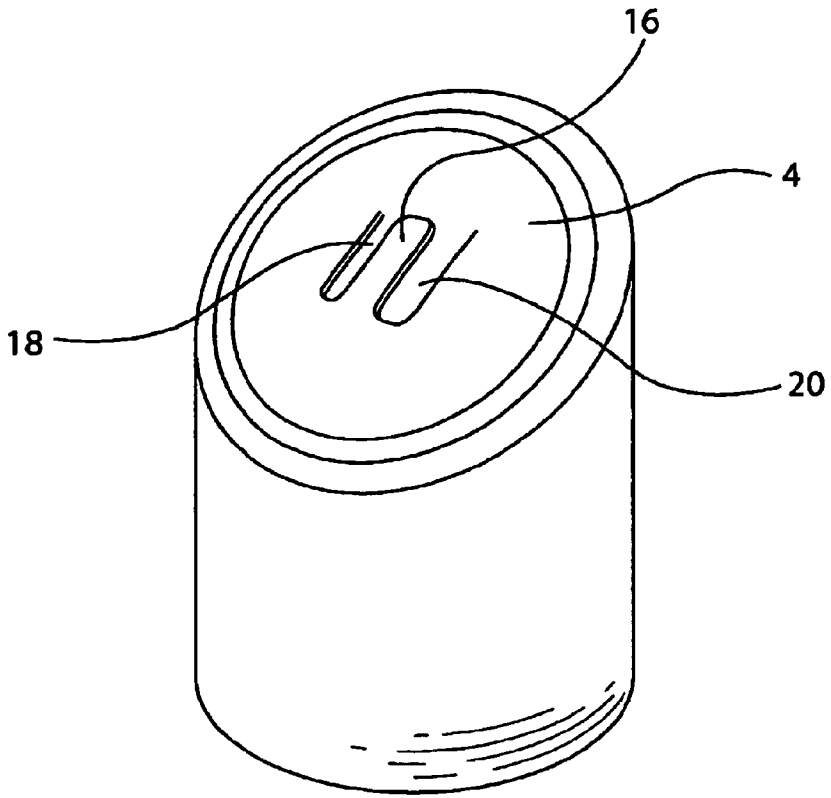
FIG. 7 illustrates a clip on a mount of a unitary molded clip, in accordance with another embodiment of the present invention.

In another embodiment of the present invention as illustrated in FIGS. 5A and 5B, clip 2 can be of a design such that clip 2 is disposed above the surface plane of base 4. In this configuration, base tab 16 extends upwardly from first downwardly extending wall 8. First and second winged projections 18 and 20 extend in the opposite direction, in the plane of the surface of base 4 such that the winged projections are disposed on either side of and parallel to tab 16. As such, as more clearly illustrated in FIGS. 6 and 7, tab 16 extends above the surface of base 4 and first and second winged projections 18 and 20 which are disposed on either side of tab 16 and extend in the plane of the surface of base 4. In this configuration, when jewelry piece 6 is clipped into position such that the shank is disposed under tab 16 and over winged projections 18 and 20, the resilient properties of winged projections 18 and 20 force the shank portion of jewelry piece 6 to be pressed firmly upward against tab 16 exposing the maximum amount of jewelry piece 6 to provide the best aesthetic view of the piece. In this embodiment all of the other advantages are retained such as sturdy storage, ability to be cleaned in clip 2, easily manipulated without getting fingerprints on jewelry piece 6, and displayed in a manner that directs the jewel of jewelry piece 6 towards the eye of the customer.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A unitary molded clip for displaying and storing jewelry, said molded clip comprising:

a base having an upper surface;

a first downwardly extending wall and a second downwardly extending wall which together form boundaries of a recess having a concave surface extending downwardly away from the upper surface of maid base;

a single tab only, said tab being relatively rigid and extending in a cantilevered manner from said first downwardly extending wall, said tab projecting substantially entirely across said concave surface of said recess in spaced relation above said concave surface; and a first deformable and resilient winged projection which extends from one said wall at a position juxtaposed to said upper surface of said base into said recess toward said tab, in a manner such that said first winged projection biases an item of jewelry inserted between said first winged projection and said tab upwardly against an undersurface of said tab to releasably secure the item of jewelry to the Unitary molded clip.

2. A unitary molded clip as claimed in claim 1, further comprising a second deformable and resilient winged projection which extends from one said wall at a position juxtaposed to said upper surface of said base into said recess toward said tab and which is disposed on an opposite side of said tab relative to said first winged projection, in a manner such that said first and second winged projections bias the item of jewelry when inserted between said first and second winged projections and said tab upwardly against an undersurface of said tab to releasably secure the item of jewelry to the unitary molded clip.

3. A unitary molded clip as claimed in claim 2, wherein said first and second winged projections are constructed of a resilient plastic.

4. A unitary molded clip as claimed in claim 2, wherein said first and second winged projections are secured to an upper edge of said second downwardly extending wall and are spaced apart from said first downwardly extending wall and said tab.

5. A unitary molded clip as claimed in claim 1, wherein said recess formed by said first and second downwardly extending wall, is triangular in shape.

6. A unitary molded clip as claimed in claim 1, wherein said recess formed by said first and second downwardly extending walls is semi-elliptical in shape.

7. A unitary molded clip as claimed in claim 1, wherein said second downwardly extending wall which forms said recess is angled downwardly at a pitch between 5–30% from horizontal.

8. A unitary molded clip as claimed in claim 7, wherein said first downwardly extending wall which forms said recess is angled downwardly at a pitch between 5–30% form vertical so as to intersect the second downwardly extending wall at a bottom of the recess at an approximately 90 degree angle.

9. A unitary molded clip as claimed in claim 1, wherein said second downwardly extending wall of said recess forms a guideway in which to manipulate the item of jewelry into a position between said tab and said first winged projection.

10. A unitary molded clip as claimed in claim 1, wherein said first winged projection extends downwardly from said one wall to a position directly beneath said tab.

11. A unitary molded clip as claimed in claim 10, wherein said first downwardly extending wall is substantially planar and extends downwardly from the upper surface of said bane at an angle relative to the upper surface of said base such that the item of jewelry inserted between said first winged projection and said tab is held snugly against the first substantially planar downwardly extending wall to releasably secure the item of jewelry to the unitary molded clip at said angle of said first substantially planar downwardly extending wall.

12. A unitary molded clip as claimed in claim 1, wherein said first downwardly extending wall is substantially planar and extends downwardly from the upper surface of said base at an angle relative to the upper surface of said base such that the item of jewelry inserted between said first winged projection and said tab is held snugly against the first substantially planar downwardly extending wall to releasably secure the item of jewelry to the unitary molded clip at said angle of said first substantially planar downwardly extending wall.

13. A unitary molded clip for displaying and storing jewelry, said molded clip comprising;

a base having an upper surface;

a first downwardly extending wall and a second downwardly extending wall which together form boundaries of a recess having a concave surface extending downwardly away from the upper surface of said base;

a tab extending in a cantilevered manner from said first downwardly extending wall, said tab projecting across the concave surface of said recess in spaced relation above said concave surface; and a first winged projection which extend, downwardly from one said wall at a position juxtaposed to said upper surface of said base into said recess toward said tab and to a position below said tab at all times, in a manner such that said first winged projection biases an item of jewelry inserted between said first winged projection and said tab upwardly against an undersurface of said tab to releasably secure the item of jewelry to the unitary molded clip.

14. A unitary molded clip for displaying and storing jewelry, said molded clip comprising:

a base having an upper surface;

a first substantially planar downwardly extending wall and a second downwardly extending wall which together form boundaries of a recess having a concave surface extending downwardly away from the upper surface of said base, said first downwardly extending wall extending downwardly from the upper surface of said base at an angle relative to the upper surface of said base;

a tab extending in a cantilevered manner from said first downwardly extending wall, said tab projecting across the concave surface of said recess in spaced relation above said concave surface; and a first winged projection which extends downwardly from one said wall at a position juxtaposed to said upper surface of said base into said recess toward said tab, in a manner such that said first winged projection biases an item of jewelry inserted between said first winged projection and said tab upwardly against an undersurface of said tab and snugly against the first substantially planar downwardly extending wall to releasably secure the item of jewelry to the unitary molded clip at said angle of said first substantially planar downwardly extending wall.

15. A unitary molded clip as claimed in claim 14, further comprising a second winged projection which extends from one said wall at a position juxtaposed to said upper surface of said base into said recess toward said tab and which is disposed on an opposite side of said tab relative to said first winged projection, in a manner such that said first and second winged projections bias the item of jewelry when inserted between said first and second winged projections and said tab upwardly against an undersurface of said tab to releasably secure the item of jewelry to the unitary molded clip.

16. A unitary molded clip as claimed in claim 15, wherein said first and second winged projections are secured to an upper edge of said second downwardly extending wall and are spaced apart from said first downwardly extending wall and said tab.

17. A unitary molded clip as claimed in claim 14, wherein said first winged projection extends downwardly from said one wall to a position directly beneath said tab.

18. A unitary molded clip as claimed in claim 14, wherein said second downwardly extending wall which forms said recess is angled downwardly at a pitch between 5–30% from horizontal.

19. A unitary molded clip as claimed in claim 18, wherein said first downwardly extending wall which forms said recess is angled downwardly at a pitch between 5–30% from vertical so as to intersect the second downwardly extending wall at a bottom of the recess at an approximately 90 degree angle.

* * * * *